United States Patent [19]

de Potter d'Indoye

[11] Patent Number: 4,829,726

[45] Date of Patent: May 16, 1989

[54] EXTENSIBLE CONSTRUCTION

[76] Inventor: Eric A. de Potter d'Indoye, Bloemendal, 27, B-1641 Alsemberg, Belgium

[21] Appl. No.: 945,057

[22] PCT Filed: Mar. 25, 1986

[86] PCT No.: PCT/BE86/00008

§ 371 Date: Feb. 4, 1987

§ 102(e) Date: Feb. 4, 1987

[87] PCT Pub. No.: WO86/05829

PCT Pub. Date: Oct. 9, 1986

[30] Foreign Application Priority Data

Apr. 4, 1985 [BE] Belgium ..... 0/214798

[51] Int. Cl.[4] ..... E04B 1/346

[52] U.S. Cl. ..... 52/66; 52/69; 52/64; 52/70

[58] Field of Search ..... 52/66, 67, 68, 69, 70, 52/71, 79.5, 79.9, 79.12, 79.13, 424, 111, 122.1, 126.1, 64, 79.1, 79.6

[56] References Cited

U.S. PATENT DOCUMENTS

| | | | |
|---|---|---|---|
| 3,421,268 | 1/1969 | Reynolds et al. | 52/70 |
| 3,526,066 | 9/1970 | Hagar et al. | 52/64 X |
| 3,534,512 | 10/1970 | Ballas | 52/67 |
| 3,629,982 | 12/1971 | Ballay | 52/69 |
| 4,074,475 | 2/1978 | Wahlquist | 52/70 |
| 4,522,390 | 6/1985 | Kudke | 52/69 X |
| 4,633,626 | 1/1987 | Freeman et al. | 52/69 X |

*Primary Examiner*—Michael Safavi

*Assistant Examiner*—Creighton Smith

*Attorney, Agent, or Firm*—Sughrue, Mion, Zinn, Macpeak & Seas

[57] ABSTRACT

The present invention relates to a horizontally extensible construction comprising a series of rigid prefabricated elements capable of being moved close together to render the construction more compact, for example for transport, or moved apart into the position for use to create space units between them suitable for use as dwelling units or the like, the said elements having connecting members connected to the elements by hinges which enable the construction to be placed into the position for use by the application of a force to an end element, this force being then transmitted from one element to the next by the hinges, and the construction being then capable of being moved back into the compact position by the application of a force to the element at the end in the direction which brings the elements together.

The extensible construction comprising a series of rigid frames capable of being selectively moved closer together to render the structure more compact or spaced apart to create space units between them, these frames being connected together by panels which are articulated thereto and are designed to form a floor, a ceiling and possible side walls for these space units when the construction is extended, the said panels being accommodated within the space bounded by two successive frames when the frames are brought close together so that the construction is in its compact space.

11 Claims, 12 Drawing Sheets

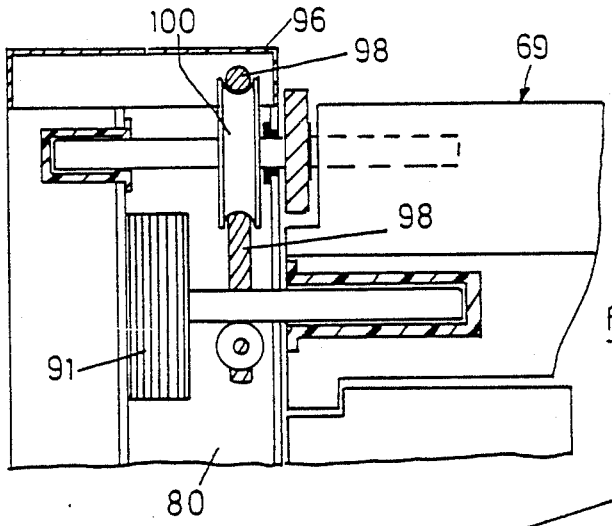
FIG. 11
FIG. 10
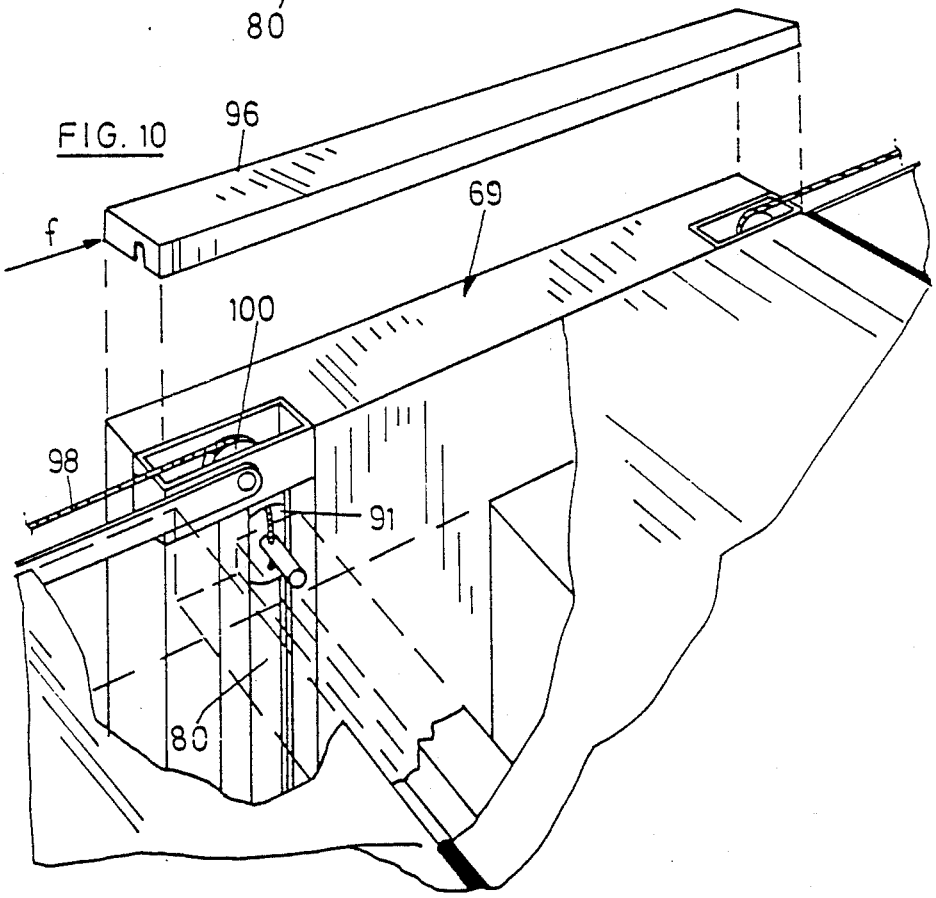

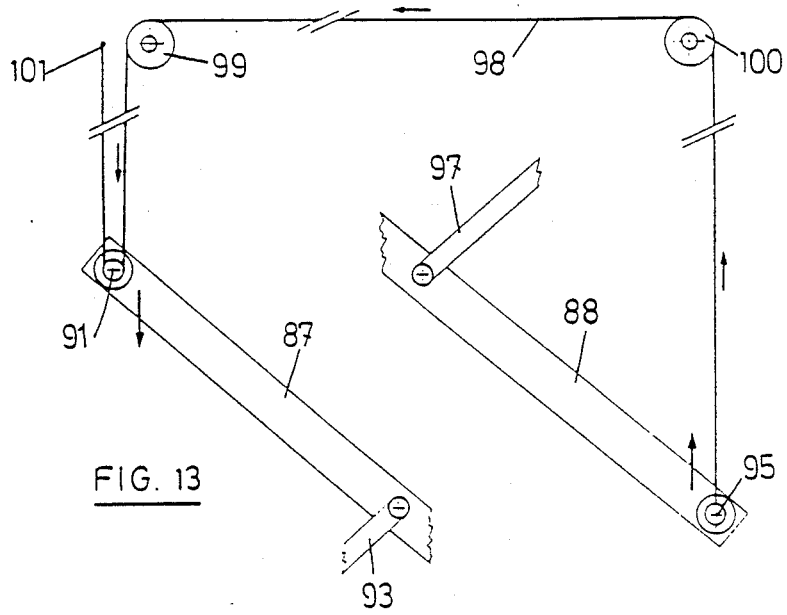
FIG. 13
FIG. 14
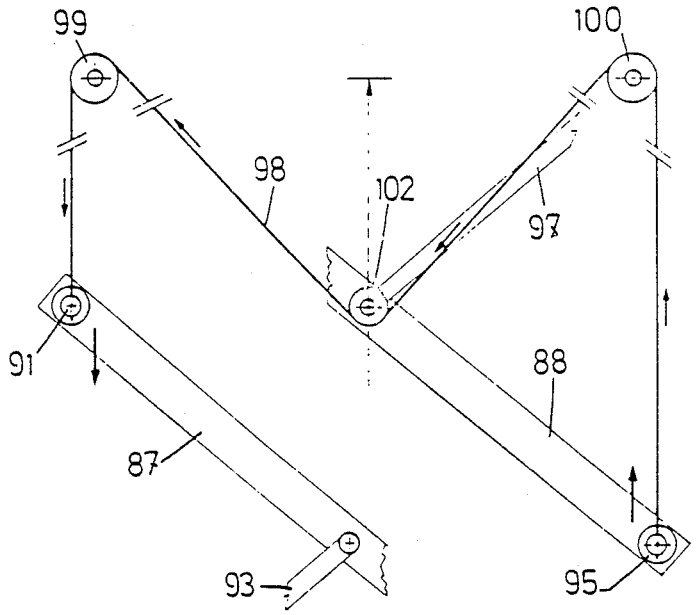

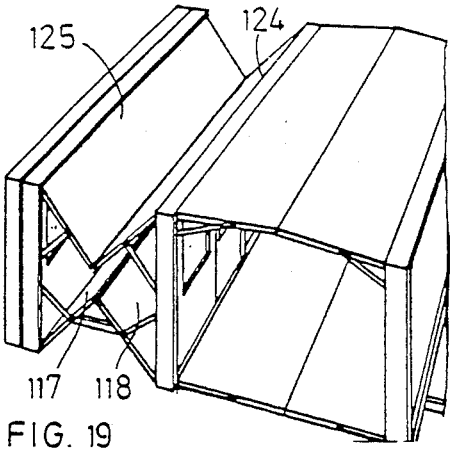
FIG. 19
FIG. 20
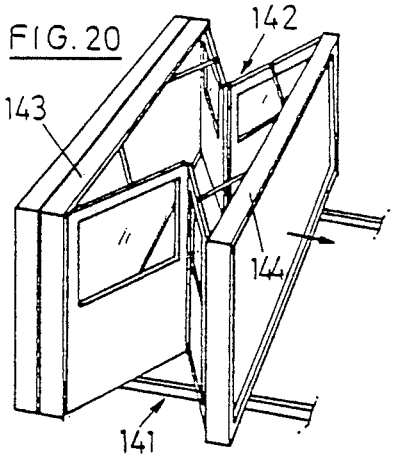
FIG. 21
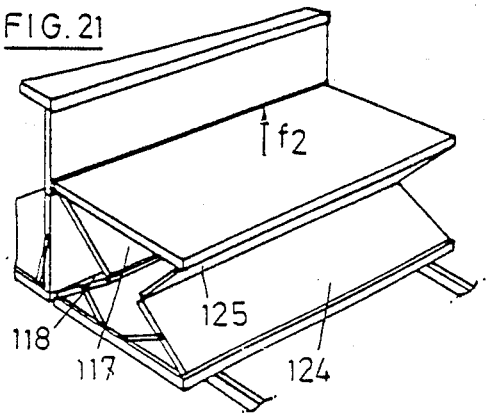
FIG. 22
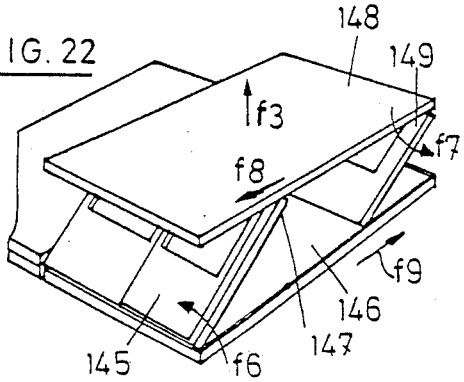
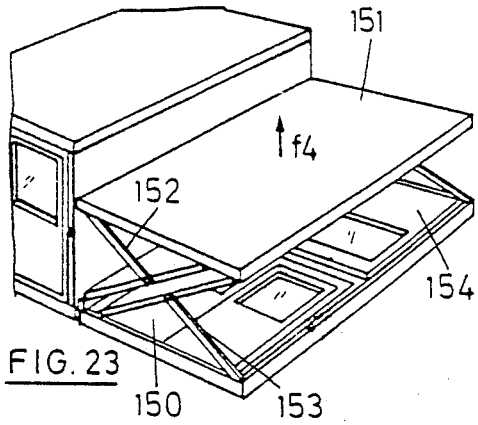
FIG. 23
FIG. 24
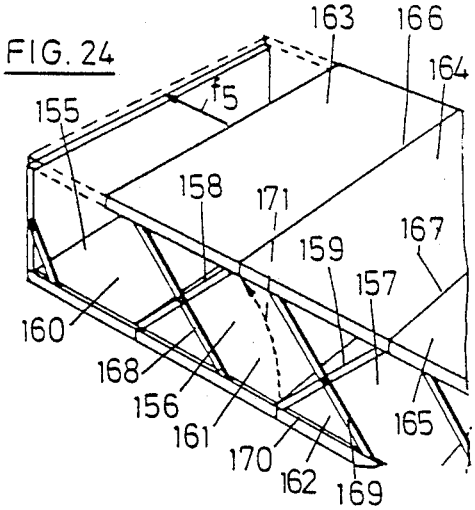

EXTENSIBLE CONSTRUCTION

The invention relates to an extensible construction.

Extensible constructions designed to be reduced in volume for transport and extended for use at their place of destination have been known in various forms for a long time. They have, however, now become increasingly important due to the natural disasters which have occurred more and more frequently in recent years and which require convenient transport and rapid installation of hospitals and other emergency medical stations, stores, workshops, etc. EP-A-0 109 108 discloses a construction of the type described in the first paragraph of the present specification. This known construction consists of an extensible shed or canopy comprising a set of gentry-like trestles or portals with wheels at their base designed to roll on rails previously placed in the ground so that the trestles or portals can be moved away from each other to stretch out the shed or canopy or brought closer together to fold it up. These trestles or portals have side walls and panels serving as ceilings hinged to them.

The side walls and ceiling panels of the shed or canopy described in the above mentioned document extend to the outside of the trestles or portals when the latter are brought close together so that the height and width of the shed or canopy are greater when the construction is folded up than when it is stretched out.

Moreover, the said shed or canopy has no elements to form a floor and is not equipped with any means for subdividing it into separate space units when it is stretched out.

Other constructions are known which are designed to be transported on wheels and are in particular in the form of trailers provided with means for increasing their volume when installed.

BRIEF DESCRIPTION OF THE INVENTION

The present invention has as its object a horizontally extensive construction which can easily be transported, preferably in a box or container by rapid, modern transport means, in particular by air.

The invention also has as its object an extensible construction which has the same height and width when stretched out as when folded up and which has not only side walls and a ceiling but also a floor.

The invention further relates to an extensible construction which can be rapidly extended without requiring special means or particular skill.

According to the present invention, the extensible construction of the type described in the first paragraph of this specification is basically characterised in that the said prefabricated elements have the form of vertical rectangular frames composed of two uprights connected together by an upper crossbeam and a lower crossbeam, and the connecting members between these frames consist of panels designed to form a floor, a ceiling and optionally side walls of the construction when the construction is extended, the said panels being accommodated in the space bounded by two successive frames when the said frames have been brought close together so that the construction is in its compact state.

In one particularly advantageous embodiment, the extensible construction according to the invention comprises a transportable box capable of containing the aforesaid frames and panels which are enclosed therein when the construction is in its compact state.

The frames and the panels articulated thereto preferably form a superstructure which rests against an infrastructure before, during and after the said frames and panels are moved closer together or stretched out, which infrastructure consists of a system of beams hinged to one another and advantageously forming horizontal rails when stretched out so that rollers mounted on the lower crossbeam of the various frames can roll on these rails.

In one particular embodiment of the construction according to the invention, a panel designed to form the floor of a space unit formed between two frames when these are spaced apart is hinged at its lower edge to the lower crossbeam of the first of these two frames while at the ends of its opposite edge it has rollers capable of rotating freely about shafts parallel to this edge in vertical rails carried by the uprights of the other frame.

In this advantageous embodiment of the invention, a panel designed to form the ceiling of the space created between two frames when these are moved apart is hinged by one of its edges to the upper crossbeam of the other frame while at the ends of its opposite edge it has rollers capable of rotating freely about shafts parallel to this edge in vertical rails carried by the uprights of the first of the said frames.

DETAILED DESCRIPTION OF THE INVENTION

Other features and details will be found in the detailed description given below with reference to the attached drawings which illustrate several embodiments given by way of example of a construction according to the invention.

FIG. 10 is a perspective view of an arrangement for attaching the compensating cable shown in FIG. 7;

FIG. 11 is an end view of FIG. 10 in the direction of the arrow f of this Figure;

FIGS. 13 and 14 are schematic representations of two different arrangements of the compensating cable of FIG. 7;

FIGS. 19 and 20 are schematic perspective views of other embodiments of the invention.

In the embodiment now to be described, the construction comprises two systems which can be stretched out like an accordian, the first system constituting a super-structure composed of upper elements which when stretched out give rise to a row of adjacent space units placed one behind the other in the direction in which the construction is extended while the second system consists of hinged beams forming an infrastructure which serves as support for the upper elements of the construction.

Figure 1:
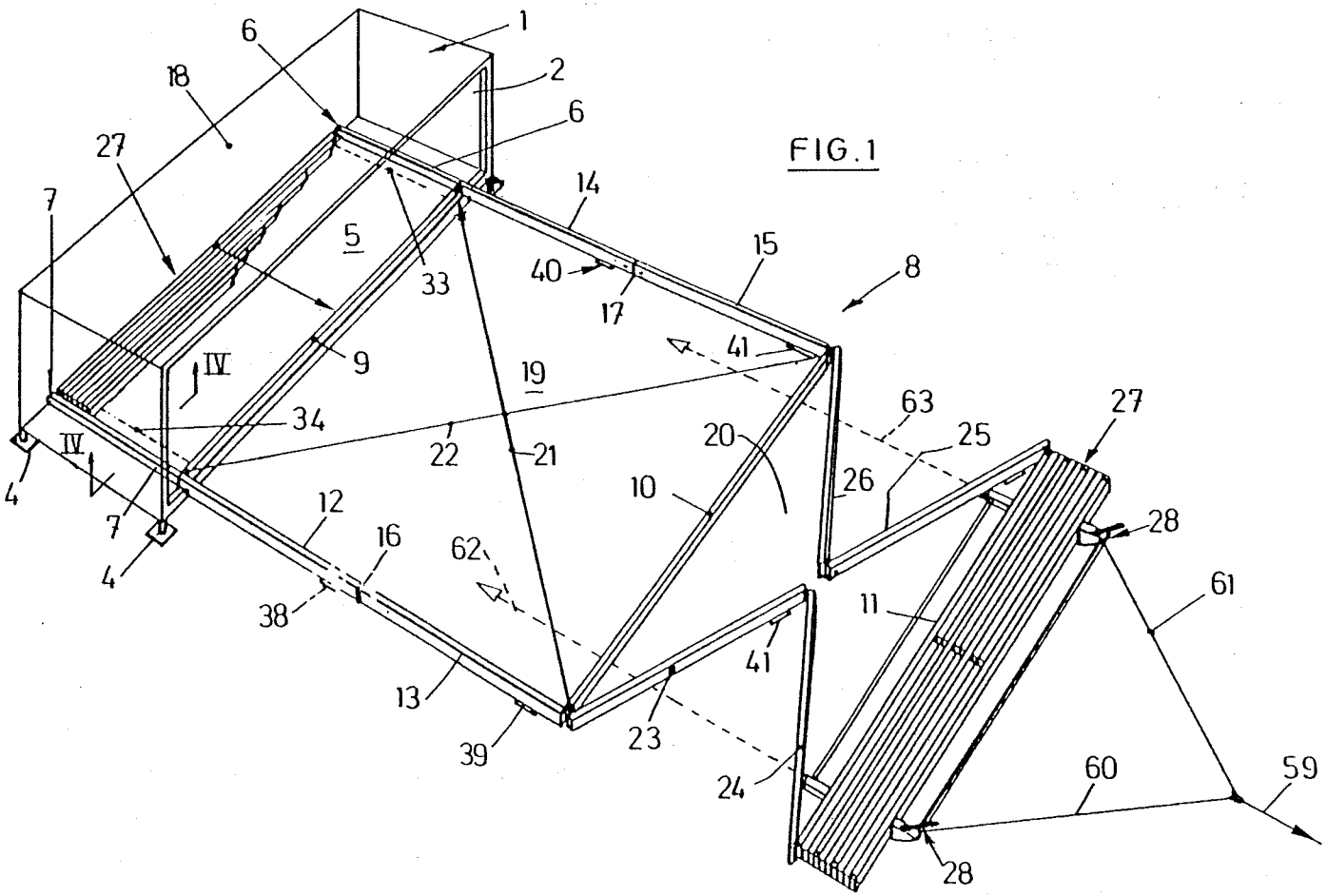
FIG. 1 is a perspective view of the infrastructure provided to support the construction while it is being extended.
Figure 4:
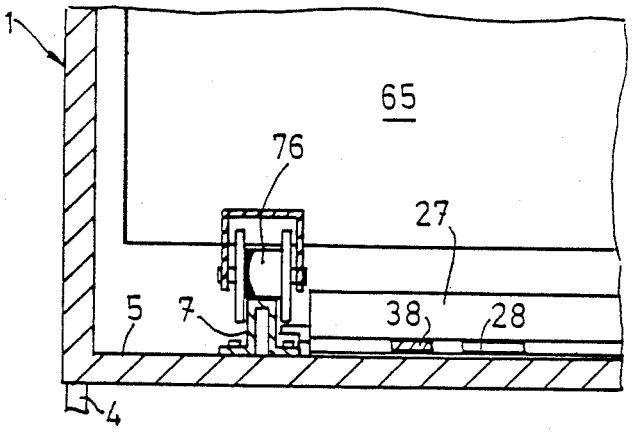
FIG. 4 is a view partly in section taken on the lines IV—IV of FIG. 1 of the lower part of the box when the construction is folded up.

When folded up, the two systems are placed inside a box 1 having the conventional dimensions of a container. On one of its vertical surfaces, this box has an opening 2 (closed by a cover 3 which will be described later) providing access to all the parts of the construction which initially are enclosed in the box. The box has independently adjustable screws 4 at each of its four corners so that it can be positioned horizontally on any terrain. The part considered as the base of the box is indicated by the reference 5. This base has two fixed rails 6 and 7 situated close to its ends and directed perpendicularly to the open side 2. These rails form a first part of the infrastructure 8. The infrastructure 8 is composed of crossbeams 9, 10, 11, which are always parallel to one another and side rails each composed of a pair of beams 12,13 and 14,15, respectively, hinged together at one end of each of the two beams as indicated at 16 and 17 in FIG. 1 while the other end of each beam is hinged to the crossbeam 9 or 10. When the construction is extended, the beams 12,13 and 14,15 are situated in line with the fixed rails 6 and 7. The infrastructure is thus composed of a row of successive cells, the first being a shorter rectangular cell contained inside the box 1 where it is bounded at the back by the wall 18 of the box and at the front by the crossbeam 9. The other cells, such as 19,20 follow one another in one and the same plane extending in the direction in which the construction is opened out. The cell 19 is shown completely stretched out and has tie rods 21 and 22 to make it rigid. The cell 20 comprising the crossbeams 10 and 11 also has hinged rails 23–24 and 25–26 as already indicated above. Before the infrastructure is extended, the crossbeams and rails folded up against one another form a packet 27 carried on a sledge 28. The sledge 28 is shown in its entirety only on the outside of the construction, but in order to enable the invention to be more clearly understood, the packet of rails and crossbeams are also shown at 27 in front of the wall 18 in the position which they take up immediately before they are extended.

Figure 2:
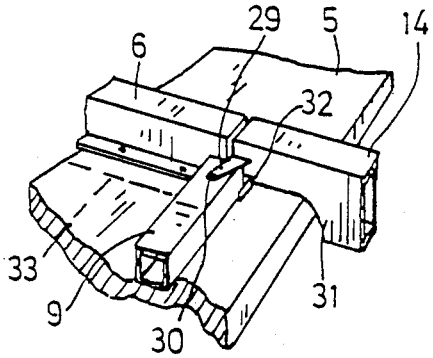
FIG. 2 and FIG. 3 show details of FIG. 1.

When folded up, the construction comprising the sledge 28 and the packet of crossbeams and rails 27 is seated between the rails 6 and 7. When extended, the rail 14 forms a prolongation of the rail 6 as shown in FIG. 2, having the same direction and the same upper level as this rail. Due to the particular form of articulation of the rails 6 and 14, however, it is nevertheless possible to fold up the rails in such a manner that their upper level is situated well above the base 5, as may be seen from FIG. 2. The end of the rail 14 has a tongue 29 which is hinged at 30 to the end of the crossbeam 9. In addition, the rail 14 is hollowed out at the bottom and is bounded there by a curved part 31 which acts as a cam on the edge of the base 5 of the box. Due to this arrangement, the level of the upper surface of the rail 14 is raised above the level of the upper surface of the rail 6 when it is folded up so that the whole arrangement of movable, folded rails and crossbeams can be placed between the rails 6 and 7.

A similar arrangement exists at the other end of the crossbeam 9. The reference numeral 32 indicates a stop block and 33 and 34 indicate cables connected at their one end to the crossbeam 9 and at their other end to the wall 18 of the box opposite the wall 3 to limit the extent of displacement of the crossbeam 9 when the construction is being extended.

Figure 3:
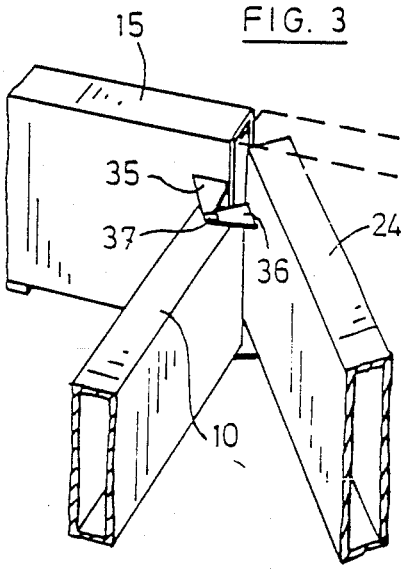

The movable rails 15,24 and the crossbeam 10 between them (FIG. 3) are also hinged together by means of tongues 35 (connected to the rail 15) and 36 (connected to the rail 24). The tongues 35 and 36 are hinged together at 37.

Figure 5:
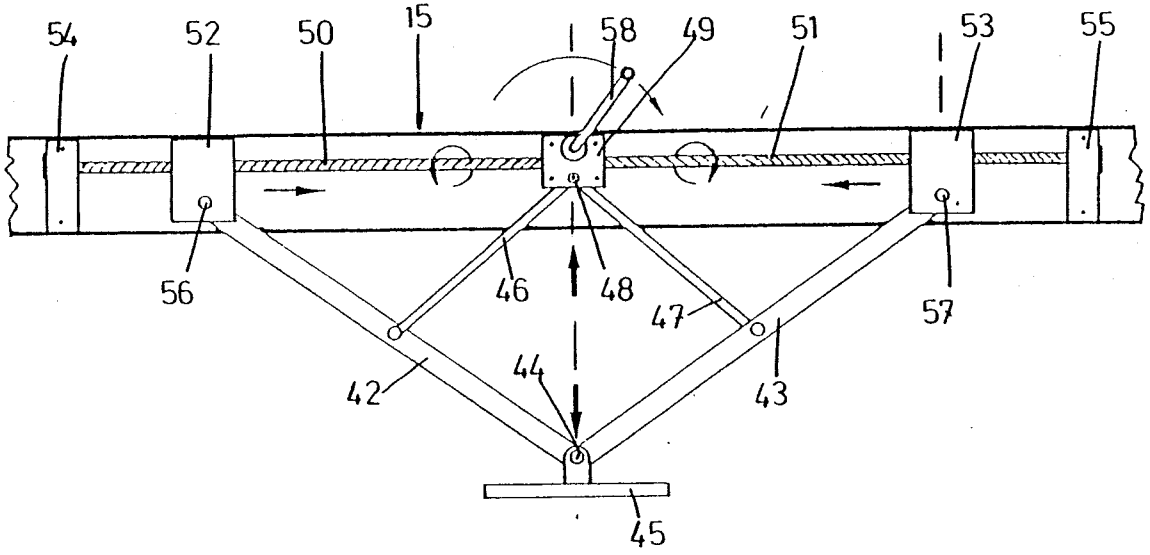
FIG. 5 is a detailed view of a device for setting up the infrastructure.

The infrastructure is completed by extensible devices 38,39,40,41 which in principle comprise (FIG. 5) each two arms 42,43 hinged to a base support 45 at 44 and connected to a fixed shoulder 49 by arms 46,47 at a hinge connection 48. The shoulder is traversed by two screws 50 and 51 the ends of which are mounted in fixed supports 54,55 and the threads of which are turned in opposite directions. Carriages 52,53 connected by hinges 56,57 to the ends of the arms 42,43 are displaceable along these screws. A crank 58 is provided to turn the screws 50,51 (by an obvious mechanism not shown) and thereby move the ends of the arms 42,43 closer together or further apart so as to adjust the height of the rail (for example, 15) in relation to the ground on which the base 45 rests. To set up the construction, the infrastructure is first extended by traction exerted on the cable 59 which transmits this force to the sledge 28 by way of the cables 60 and 61. This sledge carrying the package 27 of crossbeams and rails moves the infrastructure out of the box 1 and successively extends the various cells 19,20 of the infrastructure. This is then progressively levelled up by means of the devices 38,39,40,41, etc. so that a flat, firm foundation is formed for the superstructure described below.

To fold up the construction, the sledge 28 is moved towards the box 1 by traction on cables 62,63 attached to the sledge 28.

Figure 9:
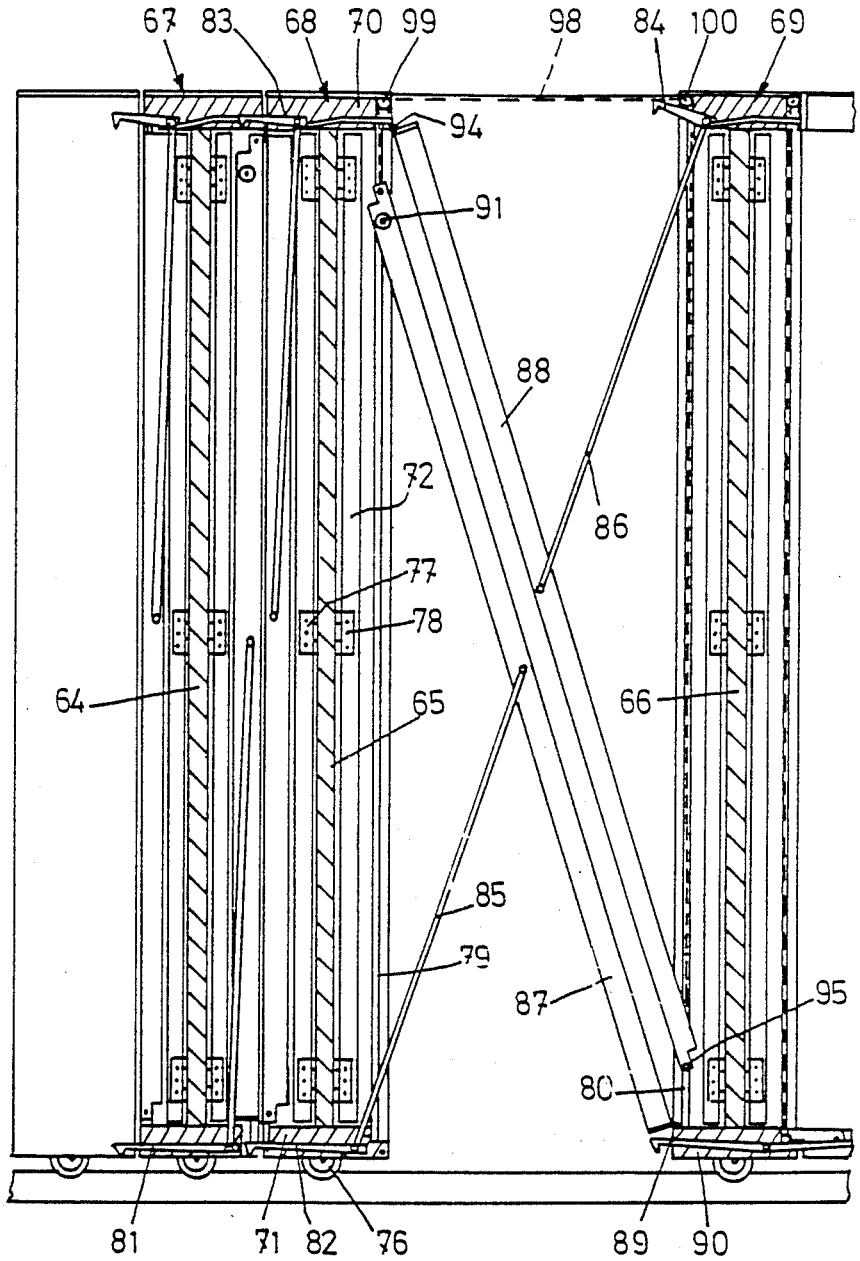
FIG. 9 is a detailed view of a part of FIG. 6.
Figure 15:
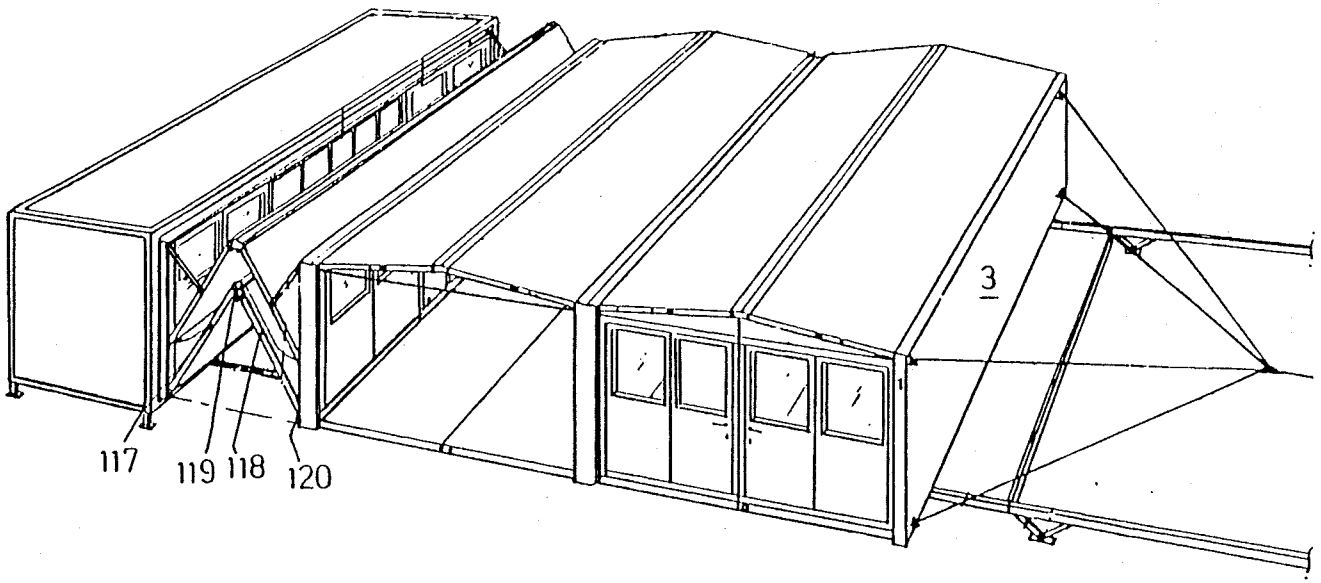
FIGS. 15, 16, 17 and 18 illustrate a second embodiment of the invention and are analogous to FIGS. 6, 7, 8 and 9 illustrating the first embodiment described previously.
Figure 16:
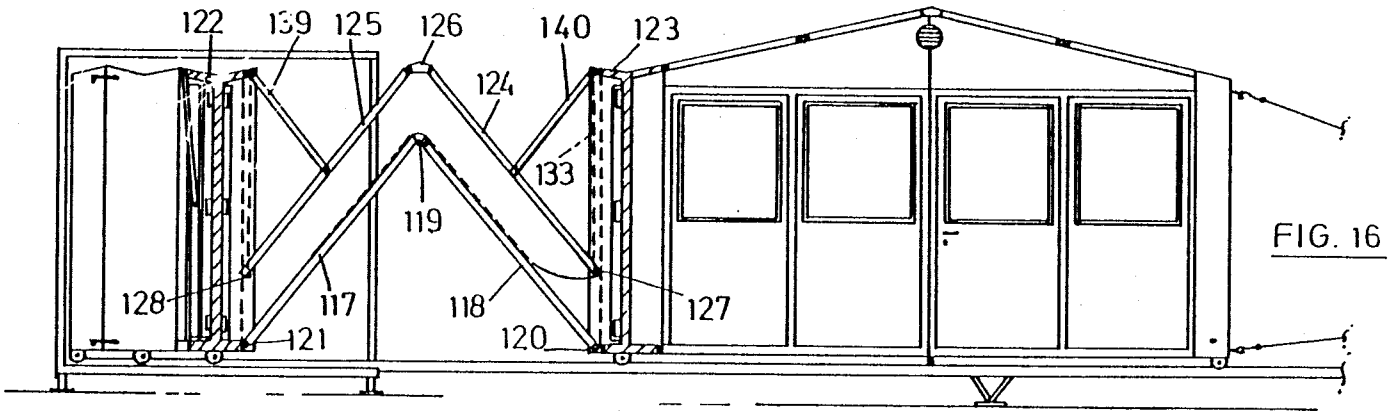
Figure 17:
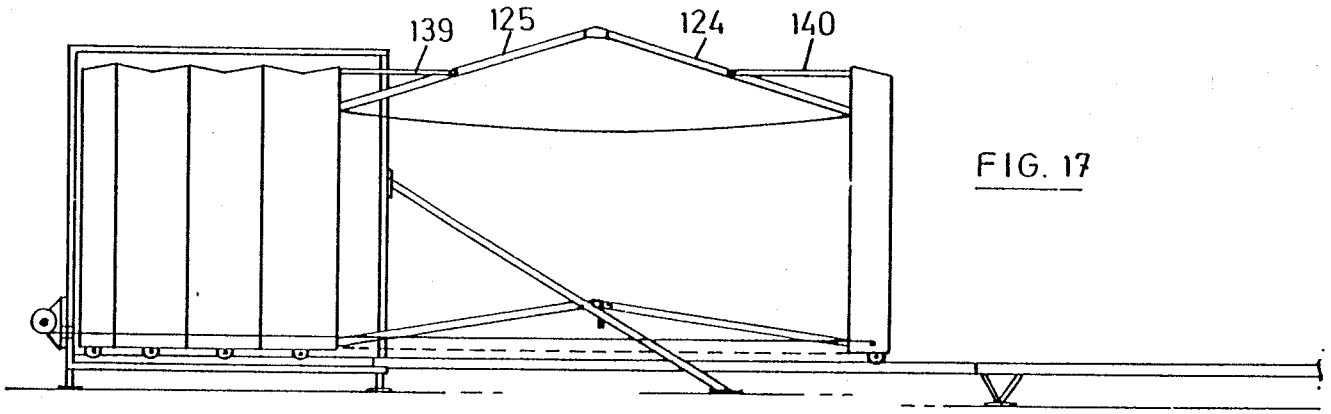
Figure 18:
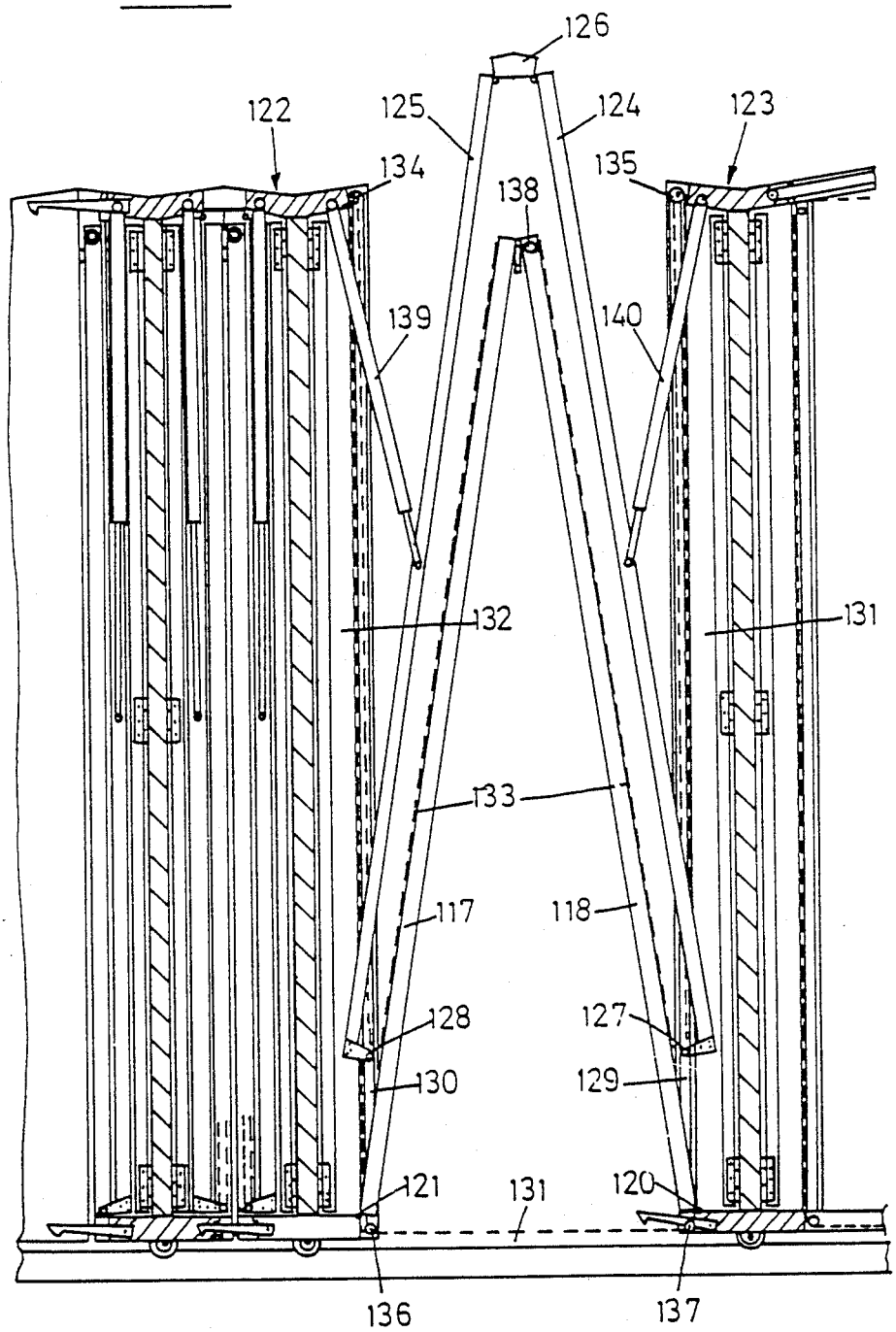

The superstructure, which constitutes the essential part of the construction according to the invention, comprises successive panels parallel to one another and perpendicular to the direction of extension of the construction. These panels are shown in vertical section in FIG. 9, each of the panels 64, 65, 66 belonging to an element 67, 68, 69 of the successive elements 67, 68, 69. Fixed to the surrounds of these panels are frames each composed of two crossbeams, an upper 70 and a lower 71 (belonging to the element 68 which alone will be described since the others are identical) and two uprights, of which only the rear upright 72 (of element 68) is shown in FIG. 9.

Figure 6:
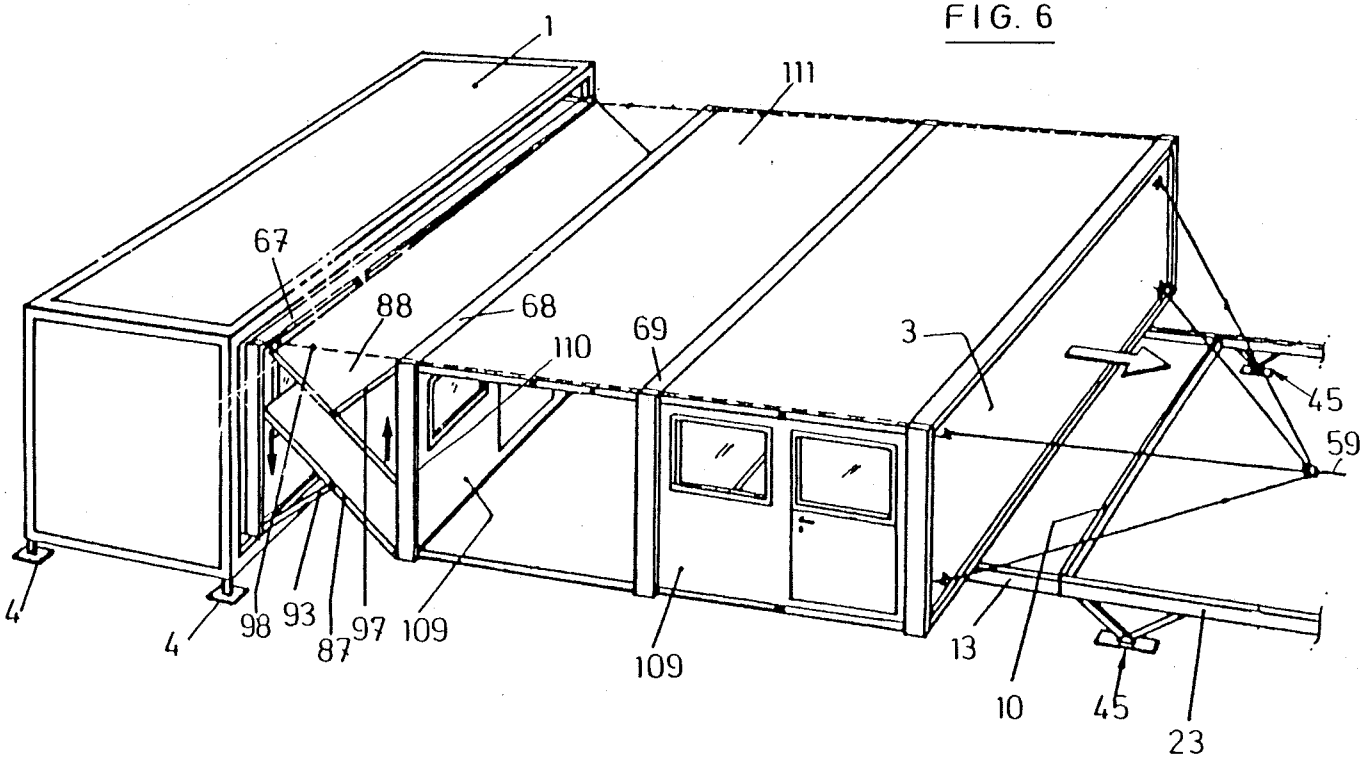
FIG. 6 is a perspective view of the infrastructure in the process of extension of a first embodiment.
Figure 7:
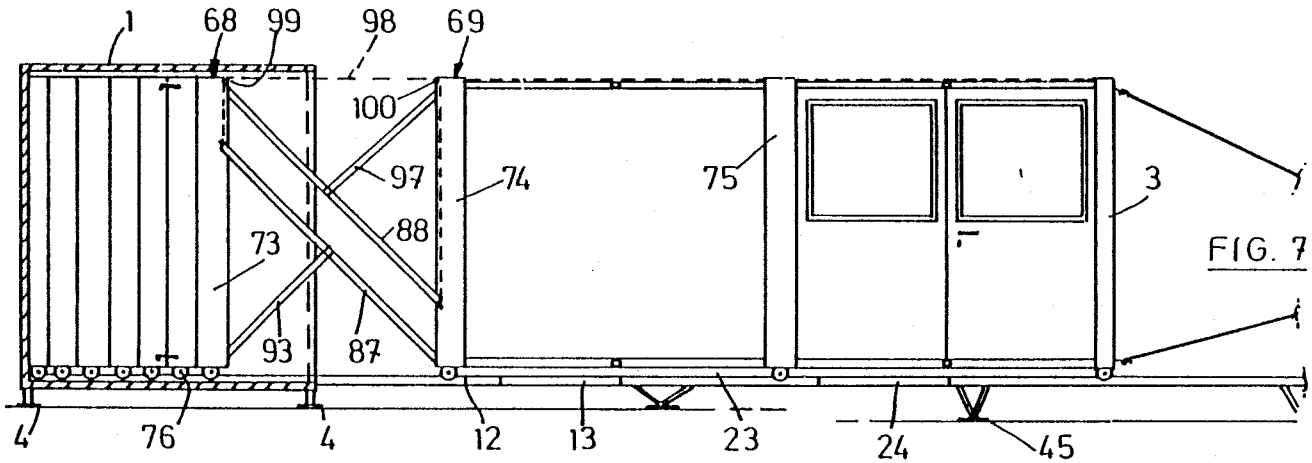
FIG. 7 is an elevational view corresponding to FIG. 6.
Figure 8:
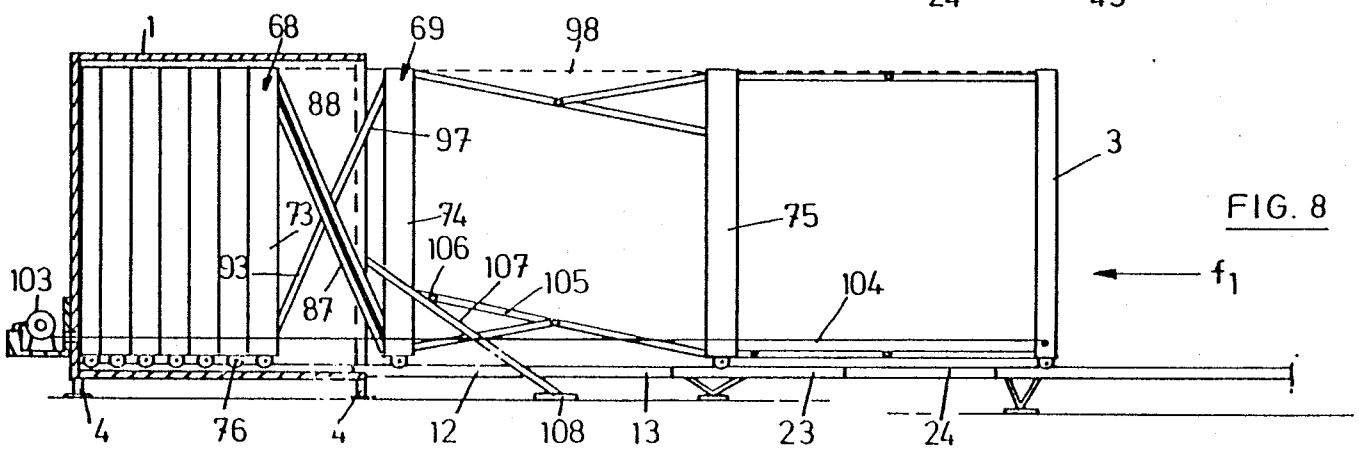
FIG. 8 is also an elevational view corresponding to FIG. 6 but showing the construction in the process of being folded up.

FIGS. 6, 7, 8 show the front uprights 73,74,75. The frames are attached to the panels by hinge plates 77,78. The lower crossbeams of the frames (such as 71 for the element 68) have rollers 76 (for the element 68) at their front and rear ends which are designed to roll on the rails 12,13,23,24 when the infrastructure is extended and are seated on the fixed rails 6,7 of the box 1 when the construction is folded up.

The uprights of the frames also have rails such as 79 (on element 68) and 80 (on element 69) the function of which will be described later. Successive elements 67,68,69 also carry locking pawls 81,82,83,84 (pivoted to the ends of the crossbeams) which hook into notches (not shown) of adjacent elements and keep the elements locked together when the construction is folded up. These locking pawls are connected by battens (85,86) to articulating devices of the construction so that when the construction is in the process of being extended these pawls are lifted one after the other to release the successive elements 67,68,69 and enable them to move away from one another.

The elements of the superstructure further comprise articulating devices connecting them to one another. When the construction is in the process of being extended by traction on an end element or frame 3, these devices are released until their end position is reached. The various space units of the construction are thus extended step by step, the extension of any one of them beginning when the extension of the preceding unit (the one closer to the point of application of traction) has been effected.

One embodiment of these articulating means and their accessory parts will now be described. In this embodiment, the parts which are articulated together are panels which in each space unit may form the floor alone or the floor and the ceiling (as in FIGS. 6,7,8,9 and in FIGS. 15,16, 17,18 in a second embodiment) or the side walls of the space unit (as in FIG. 20).

In one embodiment, the floor of the space unit bounded by the elements 68,69 is indicated by the reference numeral 87 and the ceiling by 88. The floor 87 is articulated at its lower edge (at 89) to the lower crossbeam 90 of the element 69 of the construction (see FIG. 9). At the ends of its opposite edge, at 91,92, it carries rollers, only one of which, 91, can be seen in FIG. 9. This roller slides in the rail 79 of the upright (rear upright in this case) of the element 68. At each of its lateral edges, the floor panel 87 has a side arm such as 93 (FIGS. 7 and 8) hinged at one of its ends to the middle of the corresponding edge of the panel 87 and hinged at its other end to a point (concealed by the upright 73 of the frame 68) on the lower crossbeam 71 of the frame carrying the rail 79 in which the roller 91 of the said corresponding edge (in this case rear edge) of the panel 87 is slidable.

The panel 88 which is to form the ceiling of the space unit bounded by the elements 68 and 69 is articulated by one of its edges, at 94, to the upper crossbeam 70 of the frame of the element 68 and it has rollers 95 (only one of these rollers is visible) at the ends of its opposite horizontal edge, these rollers being freely movable in the rail 80 of the element 69. A side arm 97 performs the same function as the arm 93 of the floor.

It will be understood that when the elements 68 and 69 move apart when the construction is being extended, the floor, rotating about the joint 89, and the ceiling rotating about the joint 94, take up their normal position and thereby define the size of the corresponding space unit.

Those edges of the floor panel 87 and ceiling panel 88 which carry the respective rollers 91,95 are connected together at the front and rear of the construction by, in each case, a compensating cable 98. This cable may be mounted in two different ways (FIG. 13 and FIG. 14). In FIG. 13, the cable 98 passes over two guide pulleys 99 and 100 rotating about shafts mounted in the upper crossbeams of the frames of elements 68,69 limiting the space units in the course of extension. In FIG. 13, the cable 98 passes over the pulley 91 of the floor 87 and is attached at its end (at 101) to the upper crossbeam of the corresponding frame. In FIG. 14, the cable passes over a pulley 102 mounted on the edge of the panel 88 at the point of connection of the lateral lever 97. The arrangement of the compensating cables is protected by detachable covers 96 (FIGS. 10 and 11).

If the floor panel 87 is heavier than the ceiling panel 88, it will assist in lifting the ceiling panel by the action of the cable 98 when the construction begins to be extended.

When the construction is folded up by an opposite force in the direction of the arrow f1 of FIG. 8 produced by the cable 104 being hoisted back by the winch 103, it is advantageous to facilitate the upward movement of the floor (in this case 105) by enabling a roller 106 rotatable near the end of the floor to move up along a small beam forming a ramp 107 one end of which rests on the ground at 108 and the other against the box 1. The beam 107 is removed after this operation.

FIG. 6 shows that the side walls of the construction, generally provided with windows and doors, are formed by panels 109 rotatable about a vertical hinge 110 (not visible) mounted on one of the frames which define the space unit.

Figure 12:
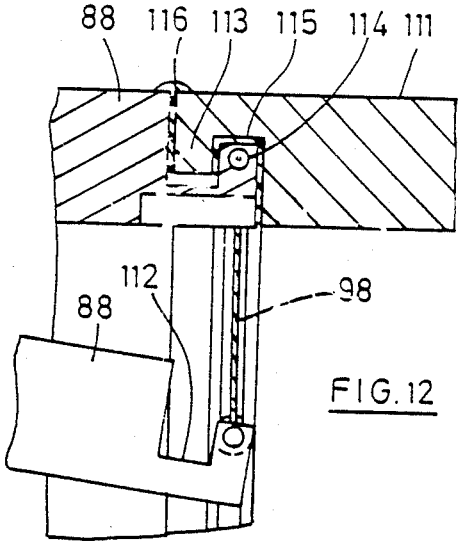
FIG. 12 is a view in section taken on the line XII-XII of FIG. 8.

It should be noted that the join between the ceiling 88 and the adjacent element 111 (FIGS. 6 and 12) is sealed by the interlocking of a groove 112 in the ceiling 88 with a projection 113 in the element 111 reinforced by the interlocking of a projection 114 in the element 88 with a groove 115 in the element 111. In addition, a seal 116 may be inserted between the interlocking parts and these may in addition be connected together by a bolt. A similar arrangement may be provided for the floors.

FIGS. 15, 16, 17 and 18 are views analogous to that of FIGS. 6, 7, 8 and 9 showing another embodiment of the invention suitable for larger space units. The floor of each space unit is in this case formed by two panels 117,118 linked together along their upper edges (at 119) and linked by their other edges 120,121 (see FIG. 16) to the lower crossbeams of the two frames (122,123) which bound the given space unit.

In this arrangement, the ceiling is formed by two panels 124,125 linked together by their upper edges carrying a ridge pole 126 while the opposite edges of the said panels carry rollers 127,128 which are slidable in rails 129,130 (FIG. 18) mounted on the uprights 131,132 of two opposite frames 123,122.

In this construction, the compensating cable 133 connecting the floor and ceiling passes over pulleys 134,135,136,137 mounted on parallel shafts at the edges of the corresponding panels. A second cable 138 connected to the outer edges of the panels 124,125 which form the ceiling act as stretching device maintaining the angle $\propto$ between these panels at a predetermined maximum value.

Each ceiling panel is linked halfway along its length by at least one telescopic arm 139,140, respectively, to the corresponding upper crossbeam of its frame 122 and 123, respectively, to limit the space unit.

FIGS. 19 to 24 illustrate schematically various forms of construction which are variations of the preceding ones.

In FIG. 19, the system of floor and ceiling panels is reversed in comparison with FIGS. 15, 16, 17, 18. That is to say, the apices of the angles formed by the respective panels in this case point in opposite directions.

In FIG. 20, the side walls 141,142 of the construction serve as connecting members articulated to opposite elements or frames 143,144. It will have been noted that the extensible construction according to this invention enables a large volume of habitable space to be obtained from at least one box or container. Since the construction according to the invention can be accommodated in a box, it can easily be transported to wherever required by rapid transport means without qualified operators or complicated machinery for positioning rails, preparing the ground and extending the construction, the latter, moreover, being effected very rapidly by simple traction exerted on the end frames or by displacement of the box from the frames.

The construction according to the invention may be used as a temporary device wherever required and after its use it can be transported to another place without any component elements such as rails, floors or foundations having to be left in position.

The elements such as the floor 87,117,118, ceiling 88,124,125, panels 64,65,66 and side walls 109 seated in the frames 67,68,69,122,123 when the construction is folded up may carry collapsible equipment such as beds, tables, cupboards, benches, etc. The depth of these frames will then vary according to the space taken up by these elements and equipment.

What I claim is:

1. Horizontally extensible construction comprising:

(a) a series of rectangular rigid frames consisting of two uprights connected together by a lower crossbeam and an upper crossbeam, said frames being connected to each other so that, when a force is applied on an end frame, the frames can be selectively moved close together for rendering the construction more compact or moved apart to create space units between them, and (b) members suitable for making respectively a floor and a ceiling, said members being connected to two adjacent frames, in which each member consists of at least one rigid panel which is brought into a substantially vertical position within a space bounded by two successive frames when said two successive frame members are moved close together for rendering the construction compact, said members being connected to the two adjacent frames, so that they form a substantially horizontal floor and a ceiling between said two adjacent frames when said two successive frame members are moved apart.

2. Horizontally extensible construction comprising:

(a) a series of rectangular rigid frames consisting of two uprights connected together by a lower crossbeam and an upper crossbeam, said frames being connected to each other so that when a force is applied on an end frame, the frames can be selectively moved close together for rendering the construction more compact or moved apart to create space units between them, and (b) members suitable for making respectively a floor and a ceiling, said members being connected to two adjacent frames, each member consisting of at least one rigid panel which is brought into a substantially vertical position within a space bounded by two successive frames when said two successive frames members are moved close together for rendering the construction compact, said members being connected to the two adjacent frames, so that they form a substantially horizontal floor and a ceiling between said two adjacent frames when said two successive frame members are moved apart, in which the panel which has a lower and an upper edge and is designed to form the floor of a space unit created between two frames by moving said frames apart is articulated at its lower edge to the lower crossbeam of a first of these two frames and carries rollers at the ends of its upper edge, which rollers are freely rotatable about shafts parallel to this upper edge in vertical rails mounted on the uprights of the second frame.

3. Horizontally extensible construction comprising:

(a) a series of rectangular rigid frames consisting of two uprights connected together by a lower crossbeam and an upper crossbeam, said frames being connected to each other so that when a force is applied on an end frame, the frames can be selectively moved close together for rendering the construction more compact or moved apart to create space units between them, and (b) members suitable for making respectively a floor and a ceiling, said members being connected to two adjacent frames, each member consisting of at least one rigid panel which is brought into a substantially vertical position within a space bounded by two successive frames when said two successive frame members are moved close together for rendering the construction compact, said members being connected to the two adjacent frames, so that they form a substantially horizontal floor and a ceiling between said two adjacent frames when said two successive frame members are moved apart, in which the panel which has a lower edge, an upper edge and lateral edges and which is designed to form the floor of a space unit created between two frames by moving said frames apart is articulated at its lower edge to the lower crossbeam of a first of these two frames and carries rollers at the ends of its upper edge, which rollers are freely rotatable about shafts parallel to this upper edge in vertical rails mounted on the uprights of the second frame, said panel being provided at each of its lateral edges with a side arm articulated at one of its ends to the middle of the corresponding lateral edge of the panel and at its other end to the lower crossbeam of said second frame.

4. Horizontally extensible construction comprising:

(a) a series of rectangular rigid frames consisting of two uprights connected together by a lower crossbeam and an upper crossbeam, said frames being connected to each other so that when a force is applied on an end frame, the frames can be selectively moved close together for rendering the construction more compact or moved apart to create space units between them, and (b) members suitable for making respectively a floor and a ceiling, said members being connected to two adjacent frames, each member consisting of at least one rigid panel which is brought into a substantially vertical position within a space bounded by two successive frames when said two successive frame members are moved close together for rendering the construction compact, said members being connected to the two adjacent frames, so that they form a substantially horizontal floor and a ceiling between said two adjacent frames when said two successive frame members are moved apart, in which a panel which has a lower edge and an upper edge and which is designed to form a ceiling of a space unit created between two frames when these frames are moved apart is articulated at its upper edge to the upper crossbeam of a first of the two frames and carries rollers at the ends of its lower edge, which rollers are freely rotatable about shafts parallel to this lower edge in vertical rails mounted on the uprights of the second of said frames.

5. Horizontally extensible construction comprising:

(a) a series of rectangular rigid frames consisting of two uprights connected together by a lower crossbeam and an upper crossbeam, said frames being connected to each other so that when a force is applied on an end frame, the frames can be selectively moved close together for rendering the construction more compact or moved apart to create space units between them, and (b) members suitable for making respectively a floor and a ceiling, said members being connected to two adjacent frames, each member consisting of at least one rigid panel which is brought into a substantially vertical position within a space bounded by two successive frames when said two successive frame members are moved close together for rendering the construction compact, said members being connected to the two adjacent frames, so that they form a substantially horizontal floor and a ceiling between said two adjacent frames when said two successive frame members are moved apart, in which a panel which has an upper edge, a lower edge and lateral edges and which is designed to form the ceiling of a space unit created between two frames when these frames are moved apart is articulated at its upper edge to the upper crossbeam of a first of the two frames and carries rollers at the ends of its lower edge, which rollers are freely rotatable about shafts parallel to this lower edge in vertical rails mounted on the uprights of the second of the said frames, said panel being provided at each of its lateral edges with a side arm articulated at one of its ends to the middle of the corresponding lateral edge of the panel and by its other end to the upper crossbeam of the second of the said frames.

6. Horizontally extensible construction comprising:

(a) a series of rectangular rigid frames consisting of two uprights connected together by a lower crossbeam and an upper crossbeam, said frames being connected to each other so that when a force is applied on an end frame, the frames can be selectively moved close together for rendering the construction more compact or moved apart to create space units between them, and (b) members suitable for making respectively a floor and a ceiling, said members being connected to two adjacent frames, each member consisting of at least one rigid panel which is brought into a space bounded by two successive frames when said two successive frame members are moved close together for rendering the construction compact, said members being connected to the two adjacent frames, so that they form a substantially horizontal floor and a ceiling between said two adjacent frames when said two successive frame members are moved apart, in which the panel designed to form a ceiling of a space unit created between two frames when these are moved apart is composed of two parts having each a lower edge, an upper edge and lateral edges, said parts being linked to a ridge pole by their upper edges, the lower edges of said parts carrying rollers which are freely rotatable in rails mounted on the uprights of the two frames, the middle of each lateral edge of said parts being articulated by at least one telescoping arm to the upper crossbeam of the frame, on the upright of which are mounted rails in which rollers of said parts are freely rotatable.

7. Horizontally extensible construction comprising:

(a) a series of rectangular rigid frames consisting of two uprights connected together by a lower crossbeam and an upper crossbeam, said frames being connected to each other so that when a force is applied on an end frame, the frames can be selectively moved close together for rendering the construction more compact or moved apart to create space units between them, and (b) members suitable for making respectively a floor and a ceiling, said members being connected to two adjacent frames, each member consisting of at least one rigid panel which is brought into a substantially vertical position within a space bounded by two successive frames when said two successive frame members are moved close together for rendering the construction compact, said members being connected to the two adjacent frames, so that they form a substantially horizontal floor and a ceiling between said two adjacent frames when said two successive frame members are moved apart, in which the panel designed to form a ceiling of a space unit created between two frames when these are moved apart is composed of two parts having each a lower edge and an upper edge, said parts being linked to a ridge pole by their upper edges, the lower edges of said parts carrying rollers which are freely rotatable in rails mounted on the uprights of the two frames, said lower edges being connected by at least one compensating cable which passes over pulleys which are freely rotatable about horizontal shafts mounted on said two frames.

8. Horizontally extensible construction comprising:

(a) a series of rectangular rigid frames consisting of two uprights connected together by a lower crossbeam and an upper crossbeam, said frames being connected to each other so that, when a force is applied on an end frame, the frames can be selectively moved close together for rendering the construction more compact or moved apart to create space units between them, and (b) members suitable for making respectively a floor and a ceiling, said members being connected to two adjacent frames, in which each member consists of at least one rigid panel which is brought into a substantially vertical position within a space bounded by two successive frames when they are moved close together for rendering the construction compact, said members being connected to the two adjacent frames, so that they form a substantially horizontal floor and a ceiling between said two adjacent frames when they are moved apart, said construction comprising a system of beams supporting the frames when they are moved apart to create space units between them and when they are moved together for rendering the construction compact so that said compact construction is enclosed in a transportable box, said system of beams comprising:

(a) crossbeams which may be selectively moved close together or moved apart by applying a force to an end crossbeam and which are perpendicular to the direction in which the frames are moved, and (b) side rails linked by their ends to the ends of two successive crossbeams, said side rails comprising two elements of equal length linked together, the length of a crossbeam being slightly greater than the total length of an extended side rail, so that the system of beams forms a succession of rectangular cells when the crossbeams of this system are moved apart.

9. Horizontally extensible construction comprising:

(a) a series of rectangular rigid frames consisting of two uprights connected together by a lower crossbeam and an upper crossbeam, said frames being connected to each other so that, when a force is applied on an end frame, the frames can be selectively moved close together for rendering the construction more compact or moved apart to create space units between them, and (b) members suitable for making respectively a floor and a ceiling, said members being connected to two adjacent frames, in which each member consists of at least one rigid panel which is brought into a substantially vertical position within a space bounded by two successive frames when they are moved close together for rendering the construction compact, said members being connected to the two adjacent frames, so that they form a substantially horizontal floor and a ceiling between said two adjacent frames when they are moved apart, in which a panel which has an upper edge, a lower edge and lateral edges and which is designed to form the floor of a space unit created between two frames by moving said frames apart is articulated at its lower edge to the lower crossbeam of a first of these two frames and carries rollers at the ends of its upper edge, which rollers are freely rotatable about shafts parallel to this upper edge in vertical rails mounted on the uprights of the second frame and in which a panel which has an upper edge, a lower edge and lateral edges and which is designed to form the ceiling of a space unit created between said two frames when moving said frames apart is articulated at its upper edge to the upper crossbeam of the second frame and carries rollers at the ends of its lower edge, which rollers are freely rotatable about shafts parallel to this lower edge in vertical rails mounted on the uprights of the first frame, said edges of the ceiling panel and floor panel which carry the rollers being connected together by at least one compensating cable passing over pulleys freely rotatable about fixed shafts on the upper crossbeams of said two frames.

10. Horizontally extensible construction according to claim 9, in which the compensating cable is connected to an edge of the floor panel and passes over a pulley which is freely rotatable about a shaft parallel to this edge, one end of this cable, after passing over this pulley, being attached to the upper crossbeam of the frame which carries, on its uprights, rails in which the rollers of said floor panel are freely rotatable.

11. Horizontally extensible construction according to claim 9, in which, between the pulleys mounted on the upper crossbeam of the frames, the compensating cable passes over a further pulley mounted to be rotatable about a shaft fixed to the middle of a lateral edge of the ceiling panel.

* * * * *